United States Patent [19]

Codd

[11] Patent Number: 4,622,795

[45] Date of Patent: Nov. 18, 1986

[54] SPACE FRAMES

[75] Inventor: Edwin T. Codd, Brisbane, Australia

[73] Assignee: Tulserate Limited, London, England

[21] Appl. No.: 740,080

[22] PCT Filed: Aug. 17, 1984

[86] PCT No.: PCT/AU84/00158

§ 371 Date: Apr. 22, 1985

§ 102(e) Date: Apr. 22, 1985

[87] PCT Pub. No.: WO85/01078

PCT Pub. Date: Mar. 14, 1985

[30] Foreign Application Priority Data

Aug. 23, 1983 [AU] Australia ..... PG0988

[51] Int. Cl.[4] ..... E04H 12/00; E04C 3/02

[52] U.S. Cl. ..... 52/648; 52/655; 403/172

[58] Field of Search ..... 52/648, 650, 655, 649; 403/171, 172, 176, 169

[56] References Cited

U.S. PATENT DOCUMENTS 4,438,616 3/1984 Codd ..... 52/655
4,505,609 3/1985 Vella ..... 403/174

FOREIGN PATENT DOCUMENTS 497390 3/1976 U.S.S.R. .
521382 1/1977 U.S.S.R. .
594269 2/1978 U.S.S.R. .

*Primary Examiner*—John E. Murtagh
*Attorney, Agent, or Firm*—Schwartz, Jeffery, Schwaab, Mack, Blumenthal & Evans

[57] ABSTRACT

A space frame consists mainly of a number of frame members, assemblies of which have their ends co-joined at nodes, the frame members connected at nod being an assembly of chords and in many cases, a further assembly of oblique struts. At a node, the nodal end of each frame member of an assembly includes transversely stepped upper and lower parts, the upper part being superimposed on the lower part of the nodal end of the next succeeding frame member of the assembly each pair of upper and lower parts superimposed at the node being secured together, for example bolts.

12 Claims, 6 Drawing Figures

SPACE FRAMES

BACKGROUND OF THE INVENTION

1. Field of the Invention

This invention relates to space frames.

2. Brief Description of the Prior Art

Space frames are extensively used in situations where shallow depth construction is required over large spans with a minimum of elastic movement under load, and a minimum number of supports.

A space frame is commonly of double-layer type, with upper and lower grids of longitudinal and lateral members, or chords, the nodes, or junctions of chords, of the upper and lower grids being interconnected by oblique struts or web members.

Although, in some space frame constructions, the nodes of the upper grid are aligned directly above corresponding nodes of the lower grid, and the struts may include vertical struts between such nodes, more commonly the upper grid nodes are displaced both laterally and longitudinally relative to the nodes of the lower grid, so that each lower grid node is equidistant from, and connected by oblique struts to, four of the nodes of the upper grid.

Other space frame constructions may include barrel-vaulted and domed structures, and a dome may be of single-layer type comprising an arrangement of hexagons and pentagons, five or six chord members being co-joined at a node.

SUMMARY OF THE PRESENT INVENTION

The general object of the present invention is to provide a space frame which may be of double-layer type, or of domed or other signle-layer type, and which is particularly simple and economical to manufacture, assemble and erect without requiring any elaborate or costly connectors. Other objects achieved in preferred embodiments of the invention are to provide such a space frame which is well suited to the economical application of weather protection and also to the application of an inner line or ceiling.

With the foregoing and other objects in view, the invention resides broadly in a space frame of the type having a multiplicity of frame members, assemblies of which have ends co-joined at nodes by connecting means, wherein, at a node, the nodal end of each of the frame members of an assembly includes two transversely stepped parts, herein called upper and lower parts; the upper part is superimposed on the lower part of the nodal end of a succeeding frame member of the assembly, and the connecting means connect together each pair of superimposed parts.

The frame members, which may be assemblies of oblique struts as well as assemblies of chord members, are preferably tubular with their ends flattened, the flattened ends being shaped to form the transversely stepped parts and the connecting means are preferably bolts equal in number to the chord ends at the node, each passed through registering bolt holes in a pair of superimposed parts and engaged by a nut. Other features of the invention will become apparent from the following description.

BRIEF DESCRIPTION OF THE DRAWINGS

In order that the invention may be readily understood and carried into practical effect, parts of space frames according to the invention are shown in the accompanying drawings, wherein.

DETAILED DESCRIPTION OF THE PREFERRED EMBODIMENT

Figure 1:
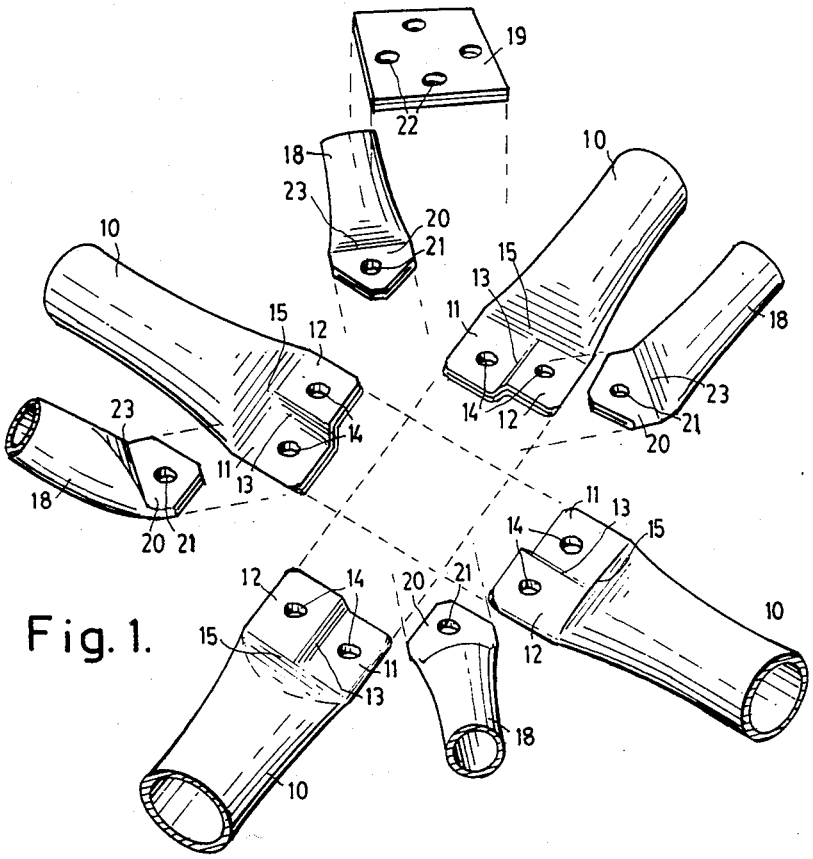
FIG. 1 is an exploded perspective view of ends of chords and oblique struts at a lower grid node of a space frame.
Figure 2:
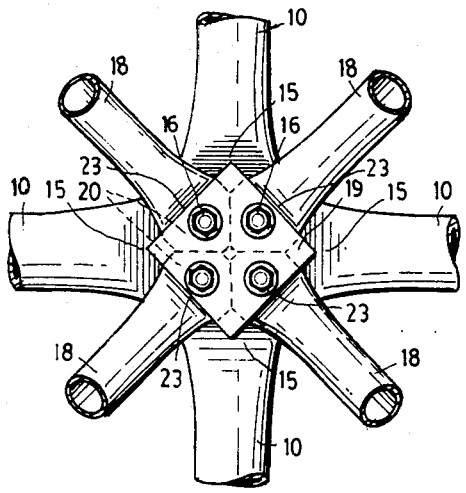
FIG. 2 is a plan view of the assembled node.
Figure 3:
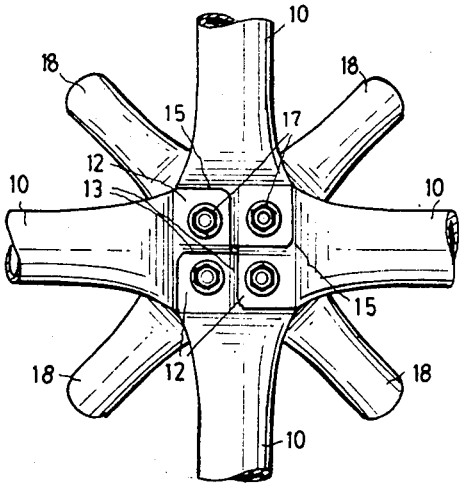
FIG. 3 is a view from below of the node shown in FIG. 2.

Referring initially to FIGS. 1 to 3 of the drawings, the chords 10 of each layer of a double-layer space frame are lengths of round-section metal tube each end of which is flattened and also deformed to a transversely stepped formation of two substantially equal adjacent parts 11 and 12. One of these parts, when they are horizontal, is above the level of the other, the top surface of the lower part 11 being substantially in the same plane as the bottom of the adjacent upper part 12, the axis of the tubular chord being in or close to this plane. The adjacent parts 11 and 12 are separated by a shoulder 13, and each of the stepped parts 11 and 12 is formed with a more or less central bolt hole 14. Each chord end may be flattened, stepped and formed with its bolt hole in a single operation.

At each node of the space frame the flattened and stepped ends of the chords 10 are interfitted, the upper part 12 of each chord end overlying the lower part 11 of the next succeeding chord end. When the chord ends are so interfitted, the upper faces of all upper parts 12 are substantially co-planar, and the lower faces of all lower parts 11 are substantially co-planar, superimposed pair of upper and lower parts 12 and 11 are brought into register. The end edges of the stepped parts 11 and 12 of each chord 10 then, as shown in FIG. 3, abut against the shoulders 13 of the next succeeding chords, and the side edges of the stepped parts 11 and 12 of each chord bear against abutments 15, at the commencement of the flattening of the ends of the succeeding chords 10.

Four bolts 16 and nuts 17 are used to interconnect rigidly the interfitted chord end parts at the node, and also to connect the ends of oblique struts or web members 18 and to secure a load distribution plate 19.

Each of the struts or web members 18 is a length of round-section metal tube of lesser diameter than the chords 10, and has each end portion 20 flattened, bent to an angle to the axis of the strut, mitred so its sides are convergent at a right angle, and formed with a bolt hole 21. The bolts 16, passing through the bolt holes 21, hold the mitred side edges of succeeding struts closely adjacent, as indicated in a broken outline in FIG. 2. The load distribution plate 19 is square with four bolt holes 22 to accept the bolts 16, on which the nuts 17 are then engaged and tightened. The sides of the load distribution plate 19 then bear against abutments 23 at the commencement of the flattening of the ends of the struts 18, and the corners of the plate bear against the abutments 15 at the commencement of the flattening of the ends of the cord members 10. The four chord members 10 and the four struts 18 are thus quickly and easily connected firmly together with very great resistance to torsional stresses. As the axes of the chords of each layer of the space frame lie substantially in the one plane, and the bolts 16 will not normally extend above the level of the chords of the upper layer or below the level of the chords of the lower level, roofing and ceiling material may be easily applied to the space frame.

Figure 4:
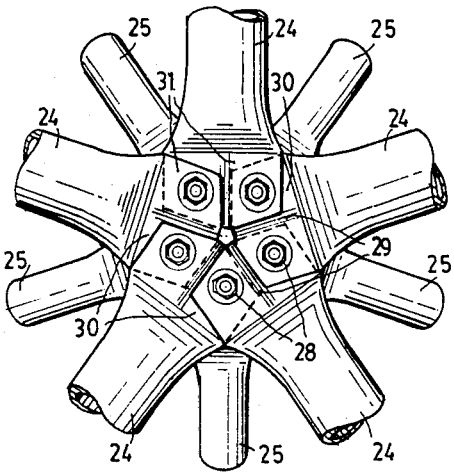
FIG. 4 is a plan view of an upper node of a space frame according to a modification of the invention.
Figure 5:
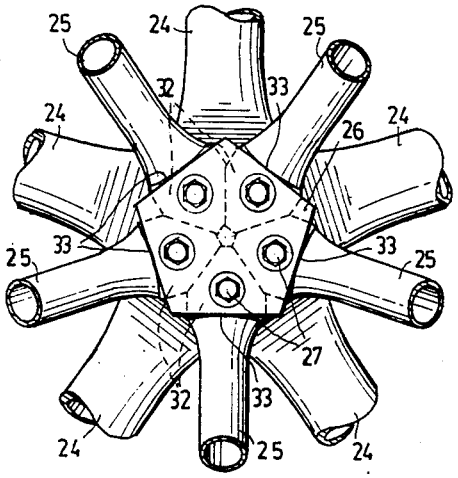
FIG. 5 is a view from below of the node shown in FIG. 4.

In the modification shown in FIGS. 4 and 5, a space frame mode is the junction of five chords 24 and five struts 25 secured, together with a load distribution plate 26, by five bolts 27 and nuts 28. The chords 24 are similar to the chords 10 before described with reference to FIGS. 1, 2 and 3 except in that the flattened and stepped end portions of the chords 25 are mitred at their extremities to an angle of 144° so that the angled outer end edges will abut against the shoulders 29 between the two stepped parts 30 and 31 of the succeeding chords.

The struts 25 again are similar to the struts 18 of FIGS. 1, 2 and 3 except in that their flattened ends 32, as indicated in broken outline in FIG. 5, are mitred to an angle of 72° for close abutment when the parts at the node are held by the five bolts 27. The sides of the pentagon-shaped load distribution plate 26 bear against abutments 33 at the commencement of the flattening and bending of the ends 32 of the struts 25.

It will be readily apparent that the invention is applicable to a space frame in which six chords and six struts are secured together by six bolts, the flattened and stepped chord ends, and the flattened strut ends, being appropriately mitred for maximum resistance to torsional stress.

It should be understood, too, that in the construction of a domed space frame, in which five chord members are co-joined in some of the nodes, and six chords are co-joined in others, the struts will be omitted if the structure is to be of single-layer type; and the axis of each chord, instead of being parallel to the planes of the stepped end parts, will be at a small angle to them, depending upon the curvature of the overall domed structure.

Figure 6:
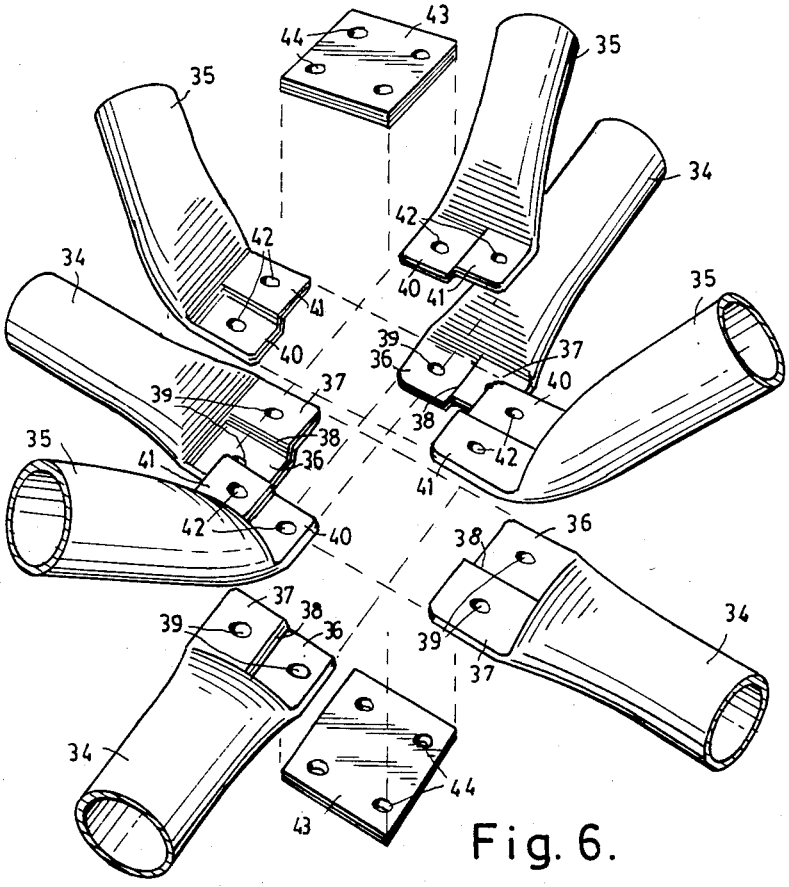
FIG. 6 is an exploded perspective view of ends of chords and oblique struts at a lower grid node of a space frame according to a further embodiment of the invention.

The parts shown in FIG. 6 are for interconnection as a node of a space frame in which corresponding chords 34 of upper and lower grids have their axes in the same vertical plane, and the axes of the struts 35 also lie in the vertical planes through the axes of the chords. The chords 34, in this case, are similar to the chords 10 described wth reference to FIGS. 1, 2 and 3, each with its ends flattened and transversely stepped to form adjacent parts 36 and 37 at different levels, separated by a shoulder 38, and with a bolt hole 39 through each.

Each of the struts 35, which is of about the same diameter as the chords 34, has its ends flattened, bent to an angle to the axis of the strut, and transversely stepped to form two adjacent parts 40 and 41 with a bolt hole 42 through each. The chord ends are interfitted as before described, and the strut ends are interfitted similarly and superimposed on the assembly of interfitted chord ends. In this example, two similar square load distribution plates 43 are provided, ech with four bolt holes 44, and one is located above, the other below, the assembly the parts of which are secured rigidly together by four bolts and nuts (not shown).

Space frames according to the invention will be found to be very effective in achieving the objects for which they have been devised. Instead of elaborate connectors being required, the nodal connections are effected simply and economically by bolts equal in number to the chords to be co-joined, each engaged by a nut. In most cases all chord members will be identical, and all oblique struts or web members will also be identical, the ends of the chord and strut members being simply and easily shaped for interconnection. At a side of a space frame grid where, for example, three instead of four chords are connected at a node, or at a corner of the structure where two chords only are connected, simple stepped and apertured filler pieces (not shown) are used for incorporation in the node assembly in place of the stepped chord ends which are interfitted in the other nodes of the space frame.

The nodes and/or the struts may of course be other than round-section tubes; for example angle members or channels with ends approrpriately shaped may be used. The foregoing and many other modifications of constructional detail and design, which will be readily apparent to persons skilled in the art, are considered to lie within the scope of the invention hereinafter claimed.

I claim:

1. A space frame including a plurality of frame members interconnected at nodes, comprising:

(a) tubular frame members each of which is flattened at its connecting end, said flattened end being formed with transversely stepped upper and lower parts separated by a shoulder, the top surface of the lower part being substantially in the same plane as the bottom surface of the top part, each of said upper and lower parts being formed with connecting openings extending therethrough, (b) said frame members being positioned so that the upper part of one frame member overlies the lower part of a laterally adjacent second frame member with the connecting openings aligned, and the lower part of said one frame member underlies the upper part of a laterally adjacent third frame member with the connecting openings being similarly aligned, said third frame member being located generally opposite but not connected to second frame member; lower and upper parts of a further adjacently disposed frame member or members being similarly constructed and aligned, and (c) connecting means extending through said connecting openings to secure said frame members at the node.

2. A space frame according to claim 1 wherein the axis of each frame member is substantially in or parallel to said plane through the surfaces of said parts.

3. A space frame according to claim 1 wherein each tubular frame member has an abutment at the commencement of the flattened end thereof, and the sides of the said stepped parts bear against abutments of adjacent frame members when the frame is connected.

4. A space frame according to claim 1 wherein the leading edges of said stepped parts of each frame member bear against the shoulders of adjacent frame members.

5. A space frame according to claim 1 wherein said frame members comprise chords of the space frame, and further including an assembly of oblique strut members having nodal ends convergent at the node and overlying said frame members, said struts being secured to said frame member by said connecting means.

6. A space frame according to claim 5 wherein the nodal ends of the strut members are flattened and mitred, the mitre angle being such that when said struts are secured by the connecting means the nodal ends are in adjacent abutting arrangement.

7. A space frame according to claim 6 wherein ech strut member is tubular and formed with an abutment at the commencement of its flattened end, and said connecting means includes a load distribution plate overlying said struts and having sides bearing on the abutments of the strut members.

8. A space frame according to claim 5 wherein the nodal end of each of the strut members includes transversely stepped upper and lower parts, the upper and lower parts of each being superimposed and below the lower and upper parts, respectively, of adjacent strut members.

9. A space frame according to claim 1 wherein said connecting means comprise bolts each passing through aligned holes in parts superimposed at the node.

10. A space frame according to claim 9 wherein said connecting means further comprise a load distribution plate.

11. A space frame according to claim 5 wherein four frame members and four struts comprise the node.

12. A space frame according to claim 5 wherein five frame members and five struts comprise the node, with the upper and lower parts of said frame members, and the mitred edges of said struts, being angled so as to provide a tight fit at the node.

* * * * *